US012241336B2

(12) United States Patent
Anderson et al.

(10) Patent No.: US 12,241,336 B2
(45) Date of Patent: Mar. 4, 2025

(54) CONTROL OF ANNULUS RETURN FLOW IN WELL OPERATIONS

(71) Applicant: WEATHERFORD TECHNOLOGY HOLDINGS, LLC, Houston, TX (US)

(72) Inventors: Neil A. Anderson, Aberdeen (GB); Michael Ronson, Dubai (AE)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 0 days.

(21) Appl. No.: 18/462,621

(22) Filed: Sep. 7, 2023

(65) Prior Publication Data

US 2025/0027382 A1 Jan. 23, 2025

Related U.S. Application Data

(60) Provisional application No. 63/514,025, filed on Jul. 17, 2023.

(51) Int. Cl.
*E21B 34/08* (2006.01)
*E21B 33/126* (2006.01)

(52) U.S. Cl.
CPC ..... *E21B 34/08* (2013.01); *E21B 33/126* (2013.01)

(58) Field of Classification Search
CPC ..... E21B 33/12; E21B 33/122; E21B 33/126; E21B 34/12; E21B 34/14
See application file for complete search history.

(56) References Cited

U.S. PATENT DOCUMENTS

| | | | | |
|---|---|---|---|---|
| 5,568,837 | A * | 10/1996 | Funk | E21B 33/068 166/383 |
| 6,298,916 | B1 | 10/2001 | Tibbles et al. | |
| 8,851,166 | B2 | 10/2014 | Foubister et al. | |
| 10,344,556 | B2 | 7/2019 | Meeks et al. | |
| 10,961,806 | B2 | 3/2021 | Carragher | |
| 11,629,573 | B2 | 4/2023 | Varhaug et al. | |
| 2009/0078407 | A1* | 3/2009 | Carro | E21B 33/129 166/187 |
| 2014/0096963 | A1 | 4/2014 | Sharma et al. | |
| 2017/0130561 | A1* | 5/2017 | Eriksen | E21B 33/14 |
| 2018/0187518 | A1* | 7/2018 | Myhre | E21B 37/08 |
| 2021/0363867 | A1 | 11/2021 | Elliott et al. | |
| 2022/0025730 | A1 | 1/2022 | Carragher | |

* cited by examiner

*Primary Examiner* — Brad Harcourt
(74) *Attorney, Agent, or Firm* — Smith IP Services, P.C.

(57) ABSTRACT

An annulus flow control tool can include an inner mandrel with a longitudinal bypass flow path, a sleeve on the inner mandrel, the sleeve being displaceable on the inner mandrel between bypass open and bypass closed positions, and at least one annular seal carried externally on the sleeve. A method of controlling annulus flow can include connecting an annulus flow control tool in a tubular string, the annulus flow control tool including a bypass flow path and at least one external annular seal, deploying the tubular string into the well, sealingly engaging a well surface with the annular seal, flowing a fluid through the tubular string into the well, thereby causing another fluid in an annulus between the tubular string and the well surface to flow through the bypass flow path, and closing the bypass flow path, the annulus flow control tool thereby blocking flow through the annulus.

18 Claims, 4 Drawing Sheets

CONTROL OF ANNULUS RETURN FLOW IN WELL OPERATIONS

BACKGROUND

This disclosure relates generally to equipment utilized and operations performed in conjunction with a subterranean well and, in examples described below, more particularly provides for control of annulus return flow in well operations.

It is beneficial in well operations to be able to control the flow of fluids downhole. Well operations typically rely on being able to place or displace fluids in a particular desired manner downhole.

Therefore, it will be readily appreciated that improvements are continually needed in the art of controlling fluid flow in wells. The present disclosure provides such improvements for control of fluid flow through an annulus in a well. These improvements may be used in a wide variety of different types of well operations.

DETAILED DESCRIPTION

Figure 1:
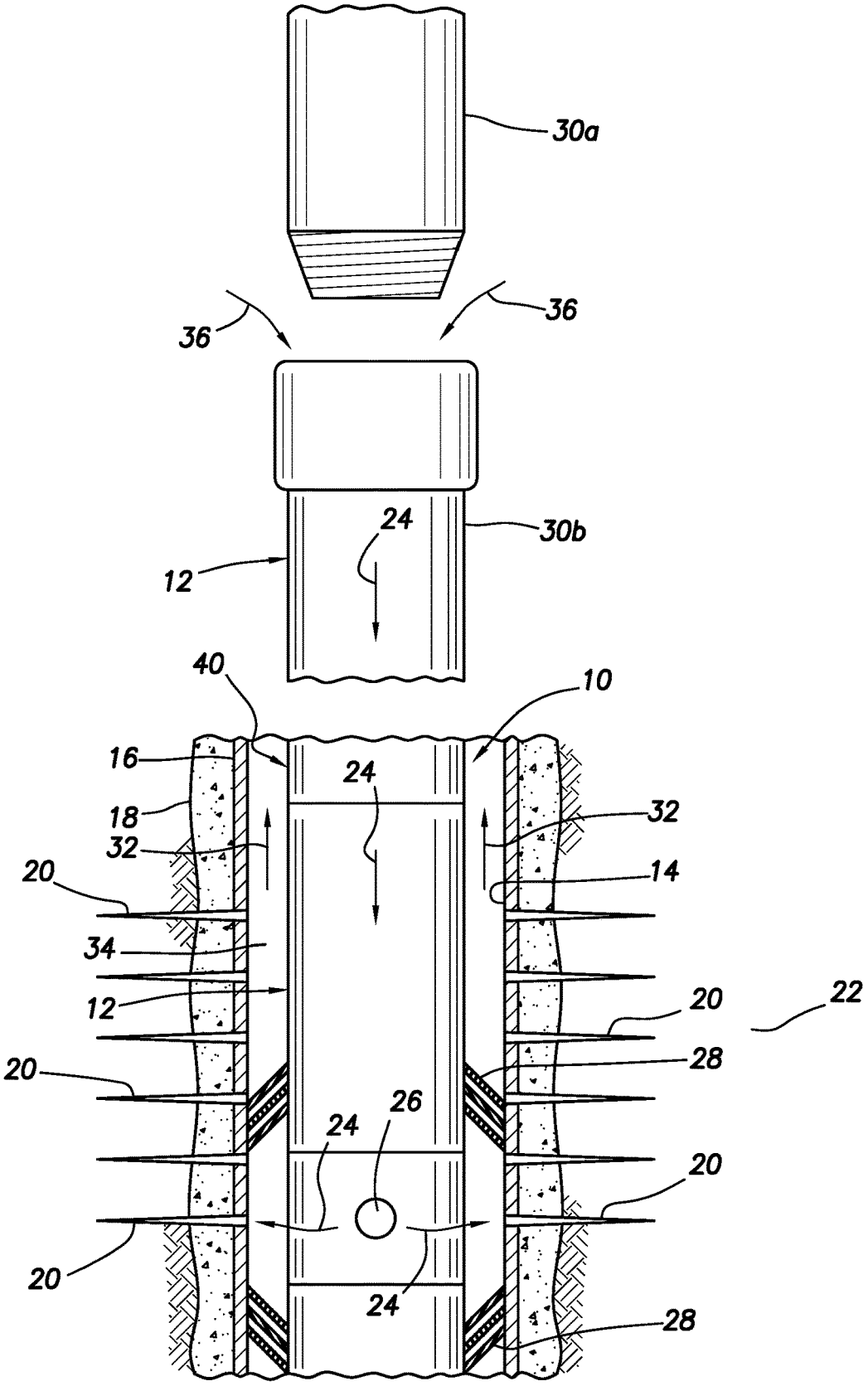
FIG. 1 is a representative partially cross-sectional view of an example of a well system and associated method which can embody principles of this disclosure.

In the detailed description below and the accompanying drawing FIGS. 1-4, examples of an annulus flow control tool 40, a method of controlling annulus flow and a system 10 for use with a subterranean well are disclosed. In one example, the annulus flow control tool 40 can include a tubular inner mandrel 44 with a longitudinally extending bypass flow path 60; a sleeve 52 on the inner mandrel 44, the sleeve 52 being displaceable on the inner mandrel 44 between a bypass open position and a bypass closed position; and at least one annular seal 50 carried externally on the sleeve 52.

The bypass flow path 60 may be formed externally on the inner mandrel 44. At least one bypass port 58 formed in the sleeve 52 may be in fluid communication with the bypass flow path 60 in the bypass open position of the sleeve 52.

The annular seal 50 may be configured to sealingly engage an interior surface 56 of a casing 16. The sleeve 52 may be adapted to displace between the bypass open position and the bypass closed position in response to a pressure differential across the annular seal 50.

An interior flow passage 64 extending through the inner mandrel 44 may be isolated from the bypass flow path 60 in the bypass open and bypass closed positions of the sleeve 52. At least one annular seal 62 may be sealingly engaged between the sleeve 52 and the inner mandrel 44 in the bypass closed position of the sleeve 52.

An example method of controlling annulus flow in a subterranean well operation can include the steps of: connecting an annulus flow control tool 40 in a tubular string 12, the annulus flow control tool 40 including a bypass flow path 60 and at least one external annular seal 50; deploying the tubular string 12 into the well; sealingly engaging a well surface 56 with the at least one external annular seal 50; flowing a fluid 24 through the tubular string 12 into the well, thereby causing another fluid 32 in an annulus 34 between the tubular string 12 and the well surface 56 to flow through the bypass flow path 60; and closing the bypass flow path 60, the annulus flow control tool 40 thereby blocking flow through the annulus 34.

The external annular seal 50 may sealingly engage the well surface 56 during the deploying step. The fluid 32 in the annulus 34 may flow through the bypass flow path 60 during the deploying step.

The closing step may include creating a pressure differential across the external annular seal 50. The closing step may include displacing the external annular seal 50 relative to an inner mandrel 44 of the annulus flow control tool 40 in response to the pressure differential created across the annular seal 50.

The external annular seal 50 may be carried on a sleeve 52 slidingly disposed on an inner mandrel 44 of the annulus flow control tool 40. The closing step may include displacing the sleeve 52 from a bypass open position to a bypass closed position. In the closing step, the fluid 24 in the tubular string 12 may have a density greater than a density of the fluid 32 in the annulus 34.

An example system 10 for use with a subterranean well can include a tubular string 12 deployed into the well, an annulus 34 being formed between the tubular string 12 and a well surface 56 surrounding the tubular string 12; and an annulus flow control tool 40 connected in the tubular string 12, the annulus flow control tool 40 including a bypass flow path 60, and at least one external annular seal 50 configured to sealingly engage the well surface 56. In a bypass open position of the external annular seal 50, fluid communication through the bypass flow path 60 between opposite sides of the external annular seal 50 is permitted. In a bypass closed position of the external annular seal 50, fluid communication through the bypass flow path 60 between the opposite sides of the external annular seal 50 is blocked.

The annulus flow control tool 40 may include a tubular inner mandrel 44. An interior flow passage 64 extending through the inner mandrel 44 may be isolated from the bypass flow path 60 in the bypass open and bypass closed positions of the external annular seal 50.

The bypass flow path 60 may be formed externally on the inner mandrel 44. The external annular seal 50 may be adapted to displace between the bypass open position and the bypass closed position in response to a pressure differential across the external annular seal 50.

The external annular seal 50 may be carried on a sleeve 52 slidably disposed on an inner mandrel 44 of the annulus flow control tool 40. At least one bypass port 58 formed in the sleeve 52 may be in fluid communication with the bypass flow path 60 in the bypass open position of the external annular seal 50.

Representatively illustrated in FIG. 1 is a system 10 and associated method which can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, a tubular string 12 is deployed into a wellbore 14 lined with casing 16 and cement 18. In other examples, the principles of this disclosure could be practiced in an uncased or open hole section of a wellbore.

FIG. 1 depicts a well operation of the type known to those skilled in the art as a "perf, wash and squeeze" operation, in which perforations 20 are formed through the casing 16 and cement 18, and into a formation zone 22 penetrated by the wellbore 14. The perforations 20 are washed, and then a cement slurry or another hardenable fluid 24 is pumped through the tubular string 12, out of the tubular string via ports 26, and into the perforations. The hardenable fluid 24 can also fill cracks and voids in the cement 18 surrounding the casing 16.

In well abandonment, the perf, wash and squeeze operation can function to establish a competent fluid barrier across productive zones of the well. However, the scope of this disclosure is not limited to well abandonment, or to perf, wash and squeeze operations.

In the FIG. 1 example, the tubular string 12 is displaced uphole as the hardenable fluid 24 is pumped into the perforations 20 between two sets of cup packers 28 carried on the tubular string. This ensures that all of the perforations 20 receive a sufficient flow of the hardenable fluid 24. However, in cases where the tubular string 12 is made up of threaded together joints or stands of tubulars 30*a,b* (such as, drill pipe, production tubing, etc.), this also means that at least one connection between the tubulars will need to be broken out.

If the fluid 24 in the tubular string 12 at the time the connection between the tubulars 30*a,b* is broken out has a greater density than fluid 32 in an annulus 34 formed between the tubular string 12 and the wellbore 14, then the greater density fluid 24 will displace the fluid 32 in the annulus (an effect known as "U-tubing"). As a result, a level of the fluid 24 in the tubular string 12 will fall and air 36 will enter the tubular 30*b*. The presence of the air 36 in the tubular string 12 will adversely affect subsequent squeeze operations.

Therefore, it would be desirable to be able to control the flow of the fluid 32 in the annulus 34. In the FIG. 1 example, this control of the fluid 32 flow in the annulus 34 is provided by an annulus flow control tool 40 connected as part of the tubular string 12, in order to prevent the "U-tubing" effect when the tubulars 30*a,b* are disconnected. However, the annulus flow control tool 40 may be used for other purposes, in keeping with the principles of this disclosure.

Figure 2:
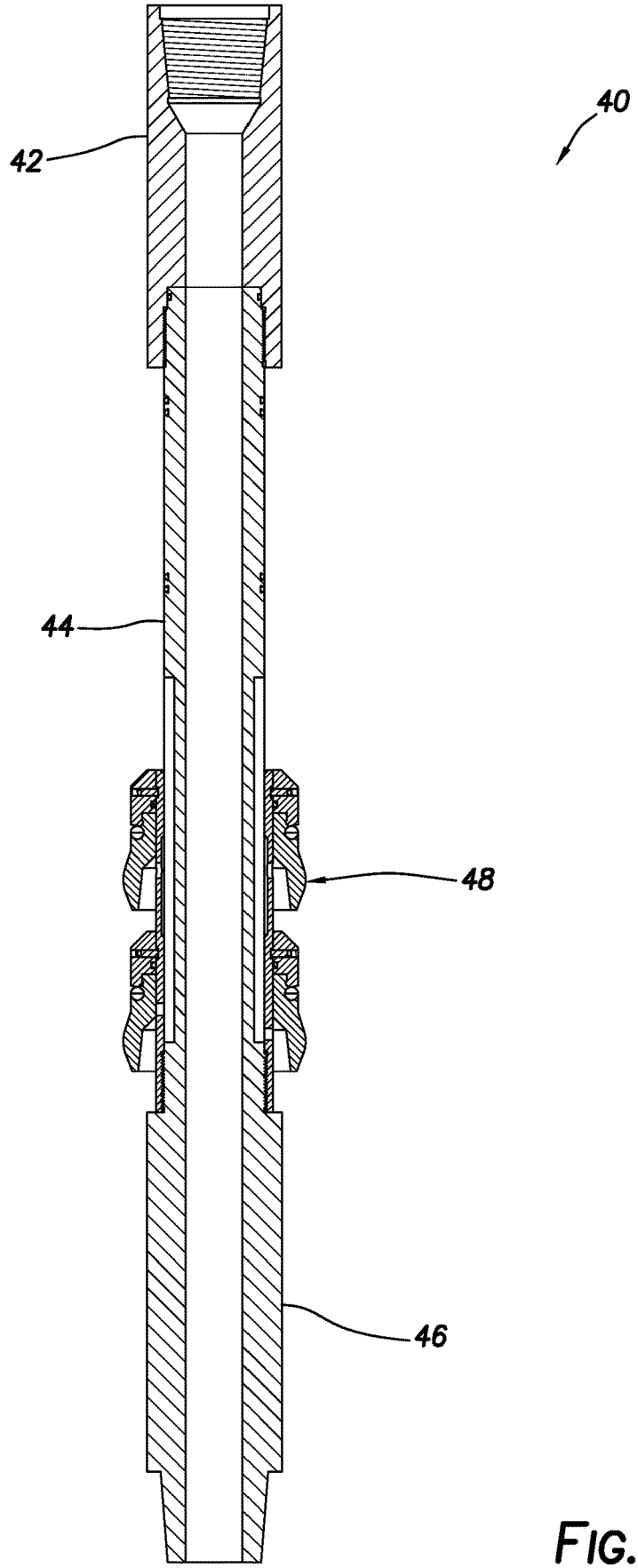
FIG. 2 is a representative cross-sectional view of an example of an annulus flow control tool that may be used in the FIG. 1 system and method.

Referring additionally now to FIG. 2, a cross-sectional view of one example of the annulus flow control tool 40 is representatively illustrated. For convenience, the tool 40 is described below as it may be used in the FIG. 1 system 10 and method, but it should be clearly understood that the tool may be used with other systems and methods.

In the FIG. 2 example, the tool 40 includes an upper connector 42 and a tubular inner mandrel 44 having a lower connector 46 formed on a lower end thereof. The upper and lower connectors 42, 46 are provided with internal and external threads, respectively, for use in connecting the tool 40 in the tubular string 12. In other examples, the tool 40 could be connected in a tubular string using other means.

An annular seal assembly 48 is positioned on the inner mandrel 44. In a run-in configuration depicted in FIG. 2, fluid in an annulus surrounding the tool 40 is allowed to bypass the annular seal assembly 48 while the tool is being deployed into a well with a tubular string. When it is desired to control the flow of the fluid in the annulus, the annular seal assembly 48 is permitted to displace on the inner mandrel 44 between a bypass closed position and a bypass open position, in which the flow of the fluid in the annulus is respectively prevented or permitted via a bypass flow path.

In the FIG. 1 system 10 and method, it is beneficial for the seal assembly 48 to be in the bypass open position while the tubular string 12 is being raised and the fluid 24 is being pumped out of the port 26 and into the perforations 20. In this manner, the fluid 32 in the annulus 34 can displace past the tool 40 as needed. However, when the tubulars 30*a,b* are being disconnected, it is beneficial for the seal assembly 48 to be in the bypass closed position, so that the fluid 32 in the annulus 34 will not be displaced by the greater density fluid 24 in the tubular string 12.

Figure 3:
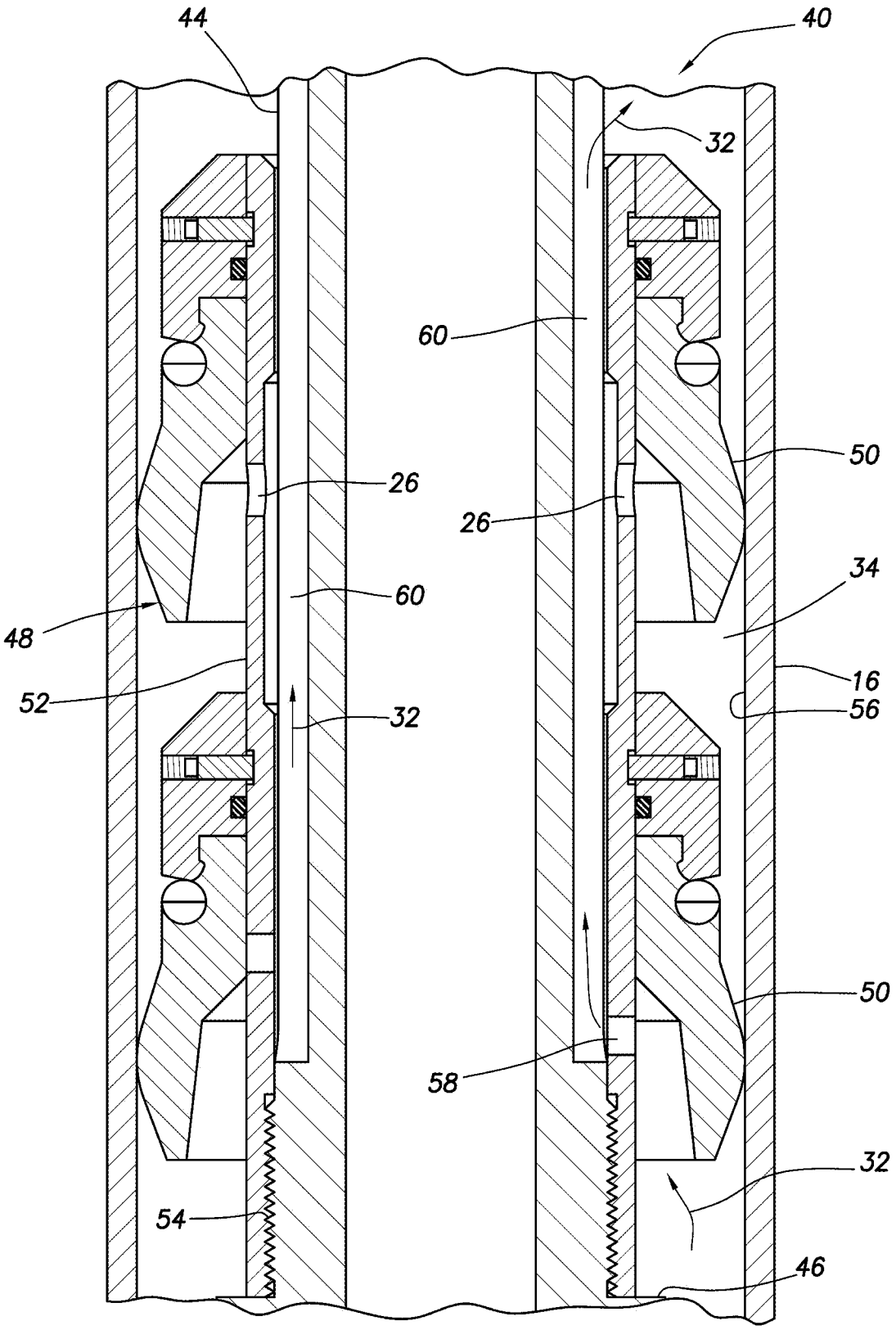
FIG. 3 is a representative cross-sectional view of a portion of the FIG. 2 annulus flow control tool in a run-in/bypass configuration.

Referring additionally now to FIG. 3, a cross-sectional view of an example of the seal assembly 48 portion of the tool 40 in the run-in configuration is representatively illustrated. The run-in configuration is also a bypass configuration, since the fluid 32 in the annulus 34 can bypass the seal assembly 48 in this configuration, as described more fully below.

In the FIG. 3 example, the seal assembly 48 includes two annular seals 50 secured on an exterior of a sleeve 52. Any number of annular seals 50 may be used in other examples. The sleeve 52 is disposed on an exterior of the inner mandrel 44.

In the FIG. 3 run-in configuration, the sleeve 52 is secured to the inner mandrel 44 with threads 54. Thus, in the FIG. 1 system 10 and method, the seal assembly 48 remains in the FIG. 3 run-in/bypass configuration while the tubular string 12 is being deployed into the well.

The annular seals 50 are configured to extend outwardly and sealingly contact a surrounding well surface 56 (such as, an interior surface of the casing 16). The annular seals 50 thereby seal off the annulus 34 between the sleeve 52 and the wellbore 14 in the FIG. 1 system 10 and method.

However, the fluid 32 in the annulus 34 is permitted to flow through bypass ports 58 formed through a wall of the sleeve 52 and into one or more longitudinally extending bypass flow paths 60 formed on an external surface of the inner mandrel 44. In other examples, the bypass flow path 60 may be formed at least partially in an interior of the inner mandrel 44, in the sleeve 52, or in another component. The scope of this disclosure is not limited to any particular components, combinations of components or configurations of components of the annulus flow control tool 40.

When it is desired to control the flow of the fluid 32 in the annulus 34 using the tool 40, the threads 54 can be disconnected to thereby allow the seal assembly 48 to displace longitudinally relative to the inner mandrel 44. For example, the tubular string 12 can be rotated clockwise (as viewed from the surface) after it has been deployed into the well, to thereby unthread the sleeve 52 from the inner mandrel 44. Other types of release mechanisms (such as, J-slots, shear members, snap rings, collets, etc.) may be used in other examples.

After the seal assembly 48 has been released for displacement on the inner mandrel 44, it can remain in a bypass open position, for example, while the fluid 24 is being pumped through the tubular string 12 and the tubular string is being displaced uphole. In the FIG. 3 example, the sleeve 52 in the bypass open position will be raised somewhat relative to the inner mandrel 44, so that the threads 54 are disconnected, but the fluid 32 will still be permitted to flow through the bypass ports 58 and the bypass flow path 60 to thereby bypass the annular seals 50.

Figure 4:
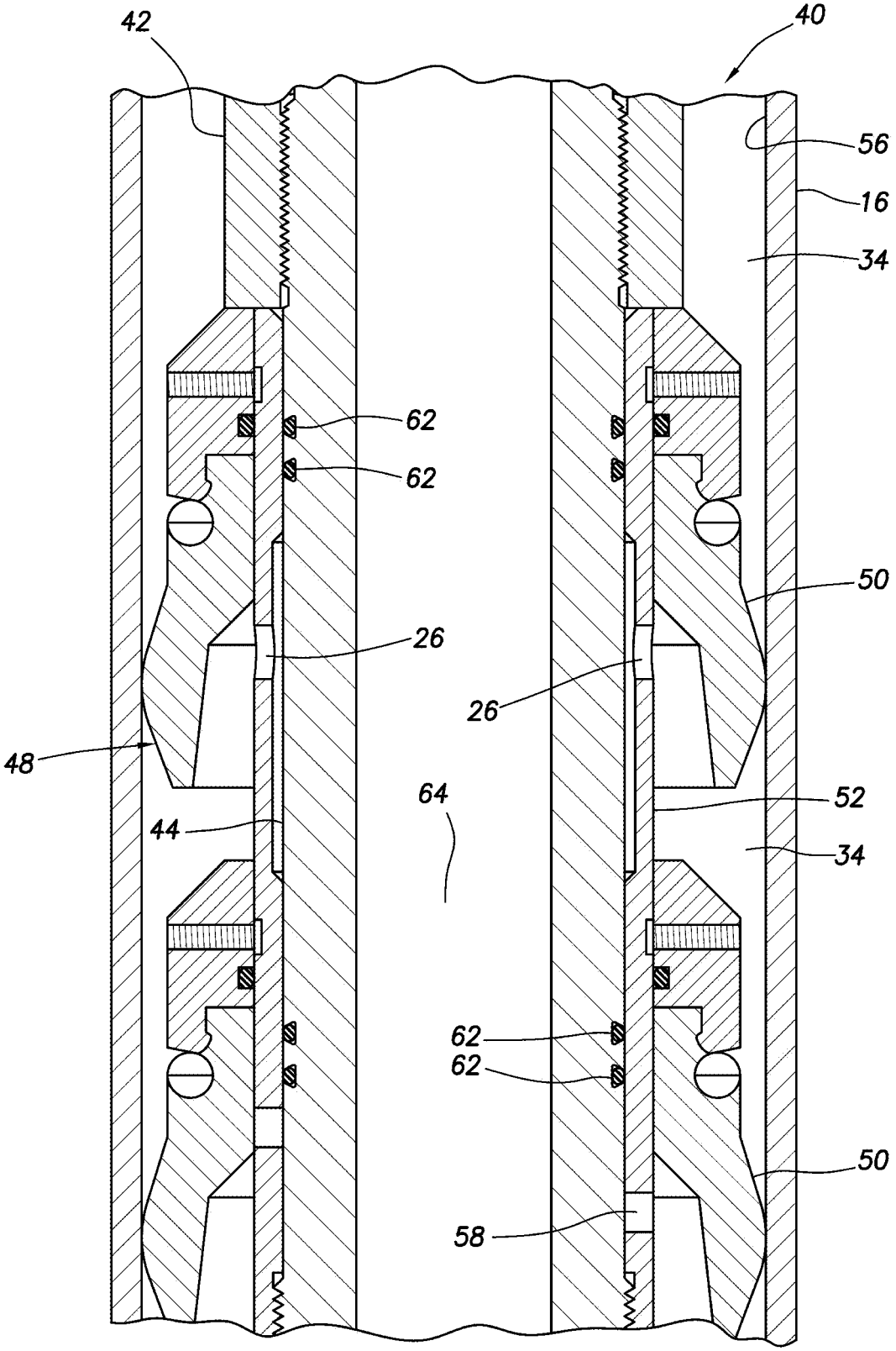
FIG. 4 is a representative cross-sectional view of another portion of the FIG. 2 annulus flow control tool in an activated configuration.

Referring additionally now to FIG. 4, a cross-sectional view of the seal assembly 48 portion of the annulus flow control tool 40 is representatively illustrated. The seal assembly 48 is in a bypass closed position as depicted in FIG. 4.

The seal assembly 48 is displaced upward relative to the inner mandrel 44, so that it now abuts the upper connector 42. As a result, the fluid 32 in the annulus 34 cannot flow through the bypass ports 58 and bypass flow path 60 to bypass the annular seals 50.

In the FIG. 4 bypass closed position, annular seals 62 carried on the inner mandrel 44 now sealingly engage an interior surface of the sleeve 52 and thereby block flow between the sleeve and the inner mandrel. The annular seals 50 block flow between the sleeve 52 and the well surface 56. Thus, flow through the annulus 34 at the seal assembly 48 is completely blocked when the seal assembly is in the bypass closed position.

In the FIG. 1 system 10 and method, the seal assembly 48 is in the bypass closed position when the tubulars 30*a,b* are disconnected. The greater density fluid 24 in the tubular string 12 will cause a pressure differential to be created from below to above the seal assembly 48, thereby displacing the seal assembly from the bypass open position to the bypass closed position. Alternatively, the tubular string 12 can be displaced downward somewhat to thereby displace the inner mandrel 44 of the tool 40 downward relative to the seal assembly 48 (friction between the annular seals 50 and the well surface 56 will resist downward displacement of the seal assembly), prior to disconnecting the tubulars 30*a,b*.

Note that a flow passage 64 extends longitudinally through the tool 40. The flow passage 64 is isolated from the bypass ports 58 and the bypass flow paths 60 in both the bypass open and bypass closed positions of the seal assembly 48.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," "upward," "downward," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. An annulus flow control tool for use in a subterranean well, the annulus flow control tool comprising:

a tubular inner mandrel with a longitudinally extending bypass flow path;

a sleeve on the inner mandrel, the sleeve being displaceable on the inner mandrel between a bypass open position and a bypass closed position; and at least one first annular seal carried externally on the sleeve, in which the sleeve is adapted to displace between the bypass open position and the bypass closed position in response to a pressure differential across the at least one first annular seal.

2. The annulus flow control tool of claim 1, in which the bypass flow path is formed externally on the inner mandrel.

3. The annulus flow control tool of claim 2, in which at least one bypass port formed in the sleeve is in fluid communication with the bypass flow path in the bypass open position of the sleeve.

4. The annulus flow control tool of claim 1, in which the at least one first annular seal is configured to sealingly engage an interior surface of a casing.

5. The annulus flow control tool of claim 1, in which an interior flow passage extending through the inner mandrel is isolated from the bypass flow path in the bypass open and bypass closed positions of the sleeve.

6. The annulus flow control tool of claim 1, in which at least one second annular seal is sealingly engaged between the sleeve and the inner mandrel in the bypass closed position of the sleeve.

7. A method of controlling annulus flow in a subterranean well operation, the method comprising:

connecting an annulus flow control tool in a tubular string, the annulus flow control tool including a bypass flow path and at least one external annular seal;

deploying the tubular string into the well;

sealingly engaging a well surface with the at least one external annular seal;

flowing a first fluid through the tubular string into the well, thereby causing a second fluid in an annulus between the tubular string and the well surface to flow through the bypass flow path;

rotating the tubular string, thereby disconnecting the at least one external annular seal from an inner mandrel of the annulus flow control tool; and closing the bypass flow path, the annulus flow control tool thereby blocking flow through the annulus.

8. The method of claim 7, in which the at least one external annular seal sealingly engages the well surface during the deploying.

9. The method of claim 7, in which the second fluid flows through the bypass flow path during the deploying.

10. The method of claim 7, in which the closing comprises creating a pressure differential across the at least one external annular seal.

11. The method of claim 10, in which the closing further comprises displacing the at least one external annular seal relative to the inner mandrel of the annulus flow control tool in response to the pressure differential creating.

12. The method of claim 7, in which the at least one external annular seal is carried on a sleeve slidingly disposed on an inner mandrel of the annulus flow control tool, and the closing comprises displacing the sleeve from a bypass open position to a bypass closed position.

13. The method of claim 7, in which, in the closing, the first fluid has a density greater than a density of the second fluid.

14. A system for use with a subterranean well, the system comprising:

a tubular string deployed into the well, an annulus being formed between the tubular string and a well surface surrounding the tubular string; and an annulus flow control tool connected in the tubular string, the annulus flow control tool including a bypass flow path, and at least one external annular seal configured to sealingly engage the well surface, in a bypass open position of the at least one external annular seal, fluid communication through the bypass flow path between opposite sides of the at least one external annular seal is permitted, and in a bypass closed position of the at least one external annular seal, fluid communication through the bypass flow path between the opposite sides of the at least one external annular seal is blocked, in which the at least one external annular seal is adapted to displace between the bypass open position and the bypass closed position in response to a pressure differential across the at least one external annular seal.

15. The system of claim 14, in which the annulus flow control tool includes a tubular inner mandrel, and an interior flow passage extending through the inner mandrel is isolated from the bypass flow path in the bypass open and bypass closed positions of the at least one external annular seal.

16. The system of claim 15, in which the bypass flow path is formed externally on the inner mandrel.

17. The system of claim 14, in which the at least one external annular seal is carried on a sleeve slidably disposed on an inner mandrel of the annulus flow control tool.

18. The system of claim 14, in which at least one bypass port formed in the sleeve is in fluid communication with the bypass flow path in the bypass open position of the at least one external annular seal.

* * * * *